US006272798B1

(12) United States Patent
Cockman

(10) Patent No.: US 6,272,798 B1
(45) Date of Patent: Aug. 14, 2001

(54) ANCHOR WITH PIVOTAL ATTACHMENT

(76) Inventor: Norman F. Cockman, 122 Melbourne La., Greenville, SC (US) 29615

( * ) Notice: Subject to any disclaimer, the term of this patent is extended or adjusted under 35 U.S.C. 154(b) by 0 days.

(21) Appl. No.: 09/577,725

(22) Filed: May 23, 2000

(51) Int. Cl.[7] ..... E02D 5/74

(52) U.S. Cl. ..... 52/155; 52/157; 248/545; 248/521; 135/118

(58) Field of Search ..... 52/157, DIG. 11; 248/156, 507, 508, 530

(56) References Cited

U.S. PATENT DOCUMENTS

D. 314,328 * 2/1991 Cobb ..... D8/373
4,863,137 * 9/1989 Cockman et al. ..... 248/545
5,456,441 * 10/1995 Callies ..... 248/521
5,713,383 * 2/1998 Ramirez et al. ..... 135/118
6,128,867 * 10/2000 MacKarvich ..... 52/157

* cited by examiner

*Primary Examiner*—Carl D. Friedman
*Assistant Examiner*—Steve Varner
(74) *Attorney, Agent, or Firm*—Flint & Kim, P.A.

(57) ABSTRACT

A post anchor capable of being in ground soil comprising an elongated metal rod, a drive section located at a first end of the rod and a boring section located below the drive section and substantially adjacent a second end of the rod. The drive end includes a drive connector, a stabilizing cap, and a mounting apparatus. The mounting apparatus mounting the stabilizing cap for swiveling motion relative to the drive end so that the stabilizing cap is adjusted for surface alignment with the ground soil when the anchor is set.

20 Claims, 4 Drawing Sheets

ANCHOR WITH PIVOTAL ATTACHMENT

BACKGROUND OF THE INVENTION

This invention is directed to an anchor for use primarily with tie-down systems for mobile homes, although it is certainly not restricted to such use.

Anchors have long been used to secure in place ropes and chains used with post and poles and also used with mobile homes. U.S. Pat. Nos. 995,297; 4,923,165; 5,157,882; and 5,927,677 each show various anchor structures as are now employed. No patent discloses an arrangement which both stabilizes the ground surface end of the anchor and maintains itself parallel with the ground surface during and after setting of the anchor into the ground soil.

Accordingly it is a primary object of this invention to provide an anchor which includes a stabilizing cap for stabilizing its upper end.

A further object of the invention is an anchor having a stabilizing cap which maintains itself parallel with the ground surface during setting of the anchor in the ground soil when the longitudinal axis of the anchor rod is not perpendicular with the ground surface.

Another object of the invention is the provision of an anchor having a stabilizing cap which pivots against the direction of pressure exerted on the anchor thereby further compacting the soil about the anchor rod.

Another object of the present invention is the provision of an anchor having a coupling which connects the stabilizing cap with the drive head in a manner which allows pivotal motion of the stabilizing cap in two directions.

Another object of the invention is the provision of an anchor which may be dissembled for shipping.

SUMMARY OF THE INVENTION

The instant invention is directed to an anchor for use with mobile homes, poles, walls, etc., with an increased resistance against bending when secured in ground soil. The post anchor comprises an elongated rod having a drive section located adjacent a first end and a boring section located below the drive section. The boring section includes at least one auger for boring into the ground soil. The drive section includes a drive connector, a stabilizing cap, and a coupling connecting the stabilizing cap with the drive connector in a manner which allows the stabilizing cap to swivel. The swiveling motion allows the stabilizing cap to be maintained in surface alignment with the ground soil during and after setting the ground soil. This swiveling capability further allows the stabilizing cap to move against pressure exerted against the rod which action further compacts the ground soil, increases the resistance against the rod bending.

The coupling comprises a pivot pin carried by the stabilizing cap and received through a pair of elongated bearings formed in the drive connector. This connection allows for longitudinal and vertical pivoting motion of the stabilizing cap.

The rod, which is normally metal, is about ¾" in diameter and about 36" in length. The stabilizing cap, which is also normally metal, is comprised of a planar disk of about 6" in diameter and which includes a 1" downwardly directed flange.

The anchor, which is primarily for use with mobile homes, comprises an elongated rod having a boring section and a drive section. The drive section includes a head secured with a first end of the rod and a stabilizing cap. The head includes a pair of fixed space upright flanges positioned laterally and above the upper end of the rod. Each flange is formed to include a substantially vertically elongated bearing. A mounting pin carried by the stabilizing cap, passes through the elongated bearing connecting the stabilizing cap with the head in a manner which allows horizontal and vertical pivotal movement of the stabilizing cap. This combination movement allows the stabilizing cap to remain aligned and evenly engaged with the ground surface about its periphery when the rod is set in the ground soil at an angle different from the longitudinal axis of the rod.

The stabilizing cap includes a central opening having a pair of upright shoulders arranged along opposed edges thereof. The opening is large enough to receive the head and to allow the pivotal movement of the stabilizing cap to take place about the head.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
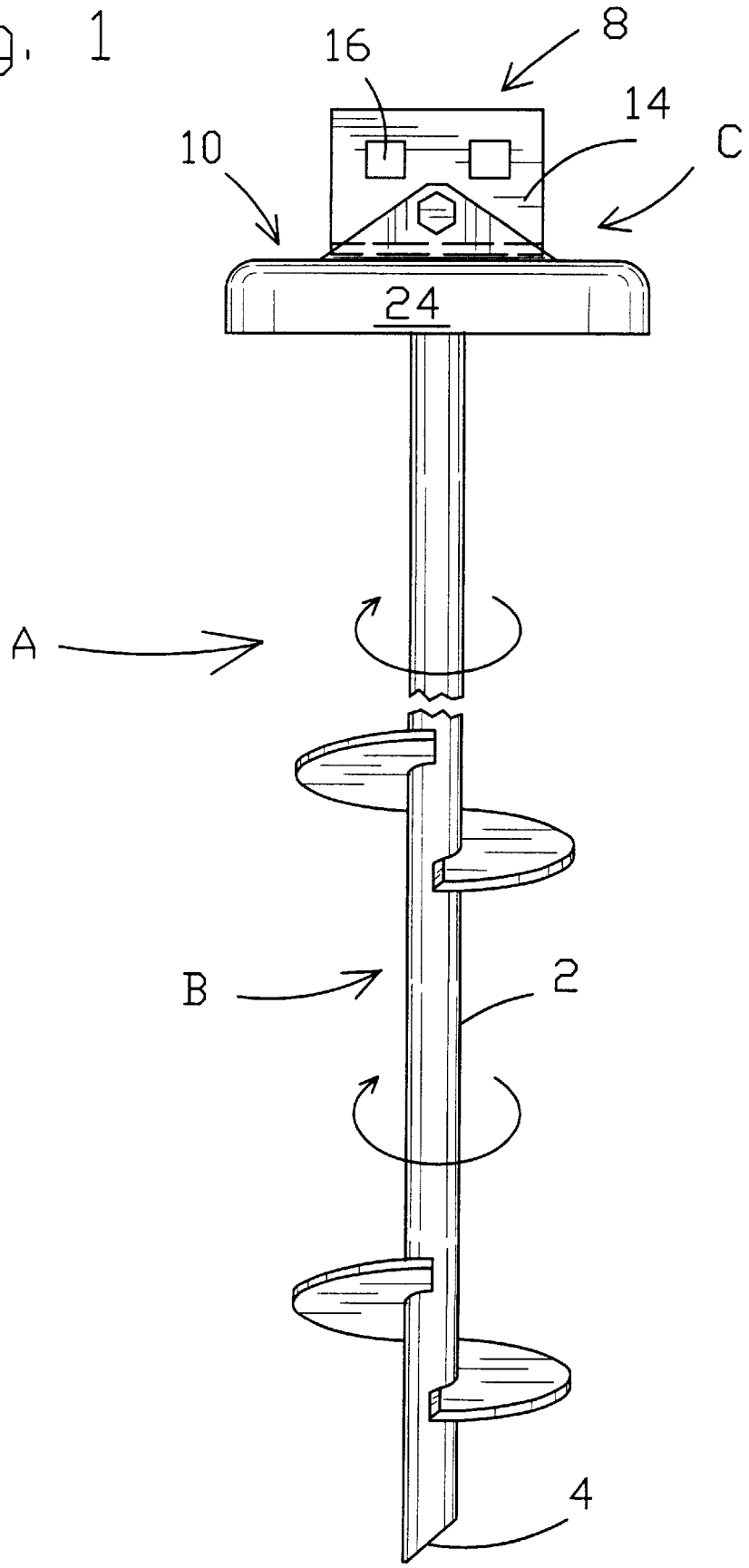
FIG. 1 is a side view of the anchor of the invention.

Turning now to the drawings, FIG. 1 shows a side view of anchor A which includes boring section B and drive section C arranged along rod 2. Rod 2, which is preferably steel, is generally about 36" in length with a diameter of about ¾". The length may vary by about 3"–6" while the diameter may be between approximately ½" to 1-¼" depending upon need. Rod 2 terminates with pointed end 4.

Boring section B, which is located adjacent the lower portion of rod 2, includes preferably a pair of spaced beveled disk or augers 4 such as is the custom with anchors of this general type. Of course, there could be more or fewer augers if desired. Augers 4 may be of any standard size and pitch.

Drive section C comprises the upper end of rod 2 and includes drive head or drive connector 8 and stabilizing cap 10.

Drive head 8 includes a substantially planar plate 12 secured with and extending perpendicularly of the upper end of rod 2. A pair of substantially upright flanges 14 are secured with a pair of opposed edges of plate 12. Each flange 14 is formed with two openings 16 which are designed to secure with the drilling implement during setting of anchor A in the ground soil and then to secure one end the attachment cables when the anchor is set. Openings 16 may be sized and shaped as needed.

At a center point of each flange 16 a vertically elongated bearing 18 is provided. Bearings 18 are axially aligned with the longitudinal axis of rod 2 and are formed to have a vertical length which is about twice the distance as is their horizontal length.

Drive head 8 may be formed as a single piece with flanges 14 being bent into position or it may be formed as a plurality of pieces with the flanges being welded in position. Preferably the drive head is 2-¾" long, 1-¾" wide, and 1-¾" high. These dimensions have been found to be most desirable, however slightly larger or smaller in all or any direction is certainly within the scope of this invention.

Figure 4:
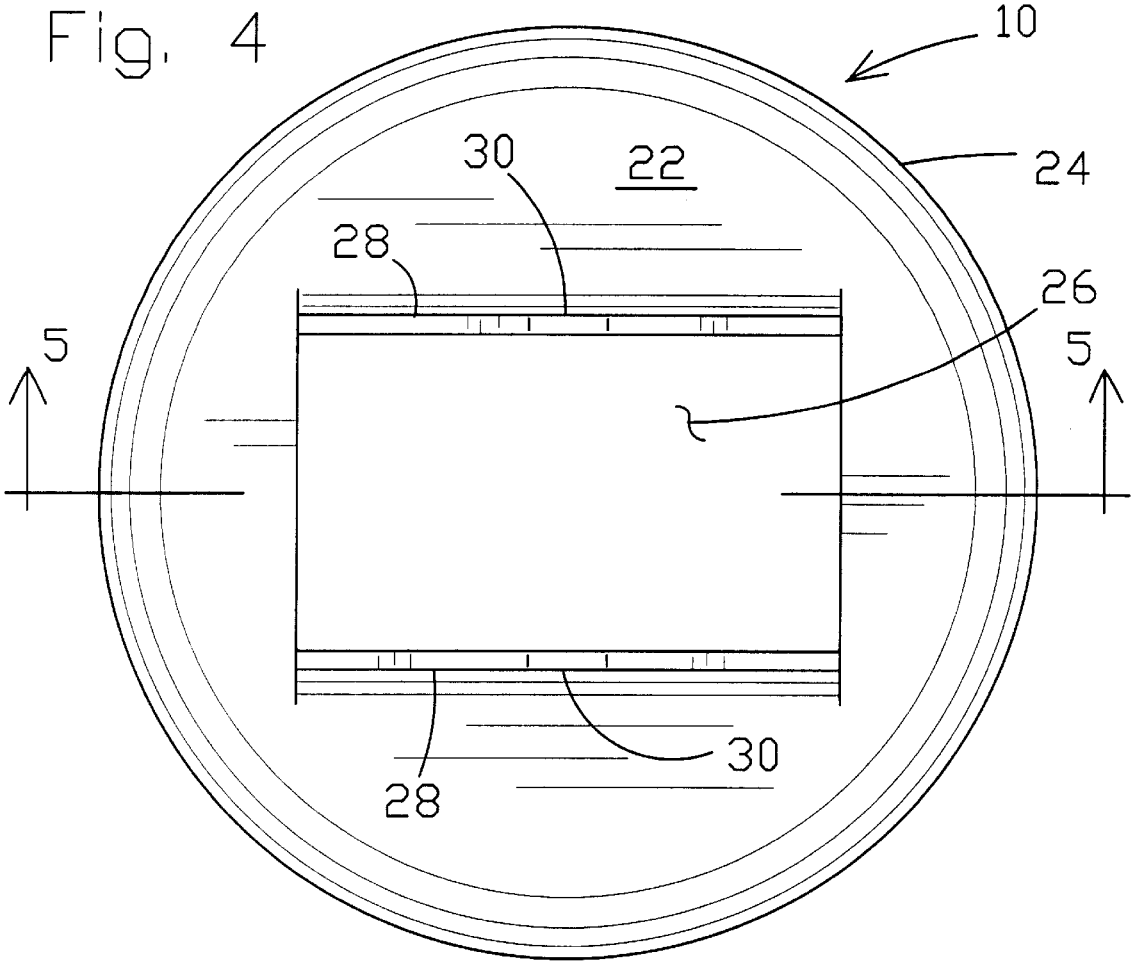
FIG. 4 is a top view of the stabilizing cap.
Figure 5:
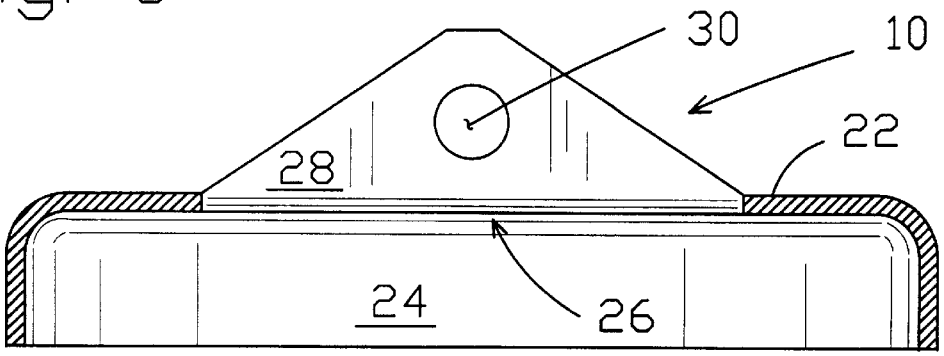
FIG. 5 is a cutaway side view of the stabilizing cap.

Stabilizing cap 1, best seen in FIGS. 4 and 5, comprises planar plate 22 formed with a down turned flange 24 about its periphery. The center portion of plate 22 is formed with opening 26 which is shaped to substantially conform with the contour of drive connector 8 but is slightly larger. A pair of shoulders 28 are connected with the upper surface of plate 22 along the opposed longer edges of opening 26. Shoulders 28 may be bent up and remain a unitary part of plate 22 or they may be separate pieces which are attached to the plate. Aligned openings 30 are formed in shoulders 28 centrally of stabilizing cap 20.

Assembled, stabilizing cap 20 is positioned over drive head 8 with openings 30 align with bearings 18. Pin 32 is passed through openings 30 and bearings 18 and is secured in position by any suitable means, in this instance a bolt. Bearing 18 allows stabilizing cap 10 pivoting motion in two directions as indicated by arrows 20, 20' in FIGS. 2 and 3.

Preferably stabilizing cap 10 is formed of 9 gauge steel. Drive head 8 is also formed of steel but of a slightly larger gauge, about 10 gauge. Pin 32 is case hardened steel with a diameter of about ¼". These sizes and materials may be changed as desired and in accordance with need.

Figure 2:
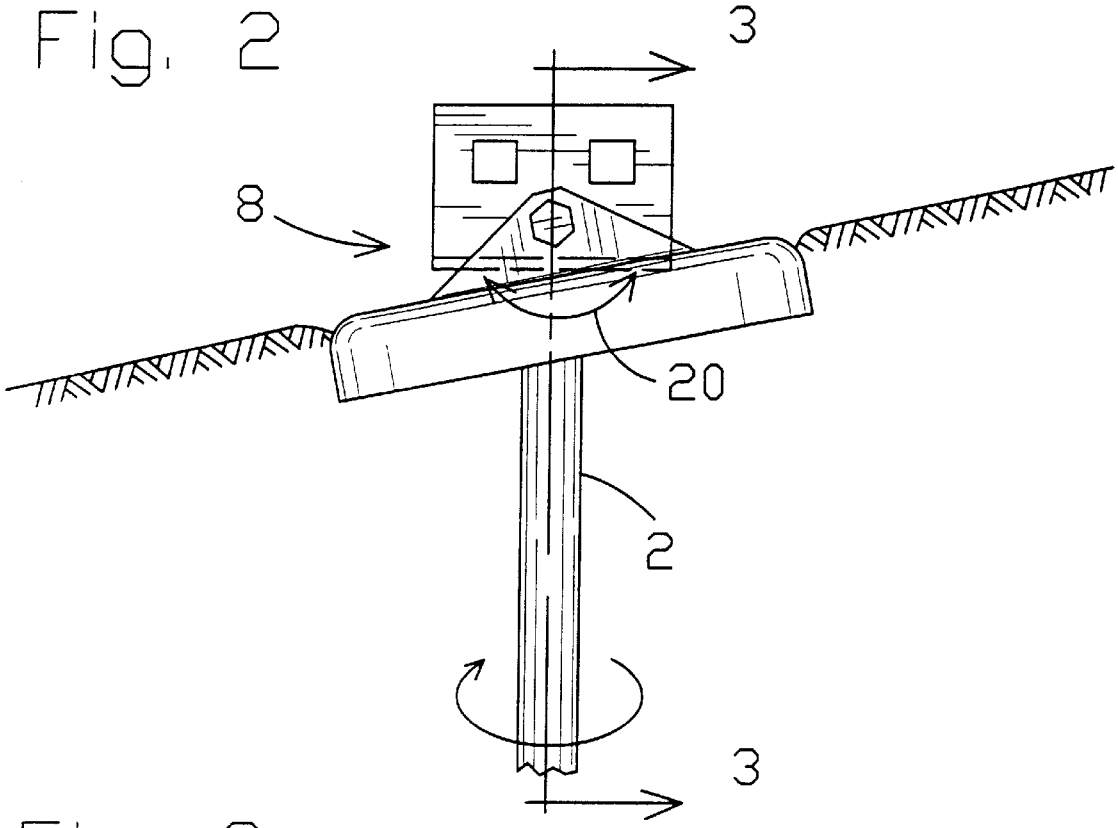
FIG. 2 is a sectional side view of the anchor secured in grown soil with the stabilizing cap pivoted along the mounting pin.
Figure 3:
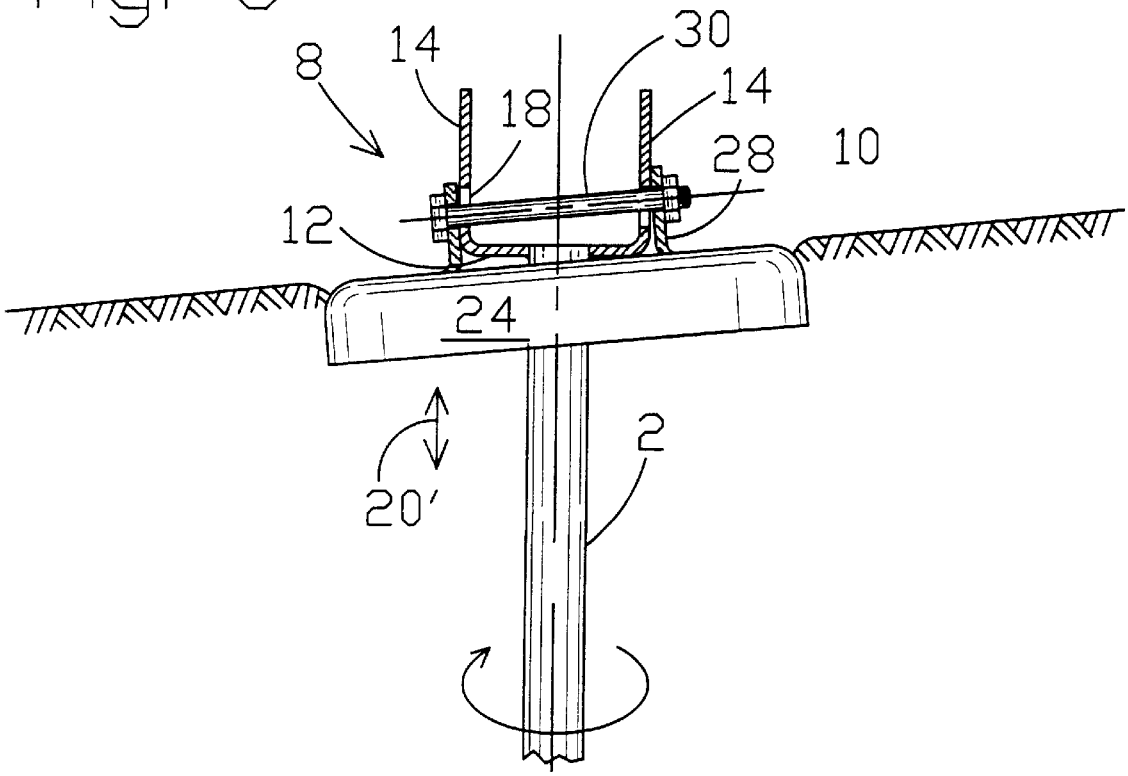
FIG. 3 is a sectional side view of the anchor secured in ground soil with the stabilizing cap pivoted along the elongated bearing.

In use, with stabilizing cap 10 assembled with drive head 8, a drive tool is connected with openings 16 and anchor A is driven into the ground. Should the ground surface be substantially perpendicular with the longitudinal axis of rod 2, flanges 14 of stabilizing cap 10 are simply driven into the ground soil until the lower face of plate 12 engages with the ground surface. Should the ground surface be at an angle to the longitudinal axis of rod 2 as shown in FIGS. 2 and 3, stabilizing cap 10 moves through swiveling motion during setting, which motion is allowed by the two directions of pivotal motion created by bearings 18. This swiveling motion allows the lower edges of flange 24 to remain in constant engagement with the ground surface about its complete periphery which assist in stabilizing rod 2 as it is driven into the ground soil.

Figure 7A:
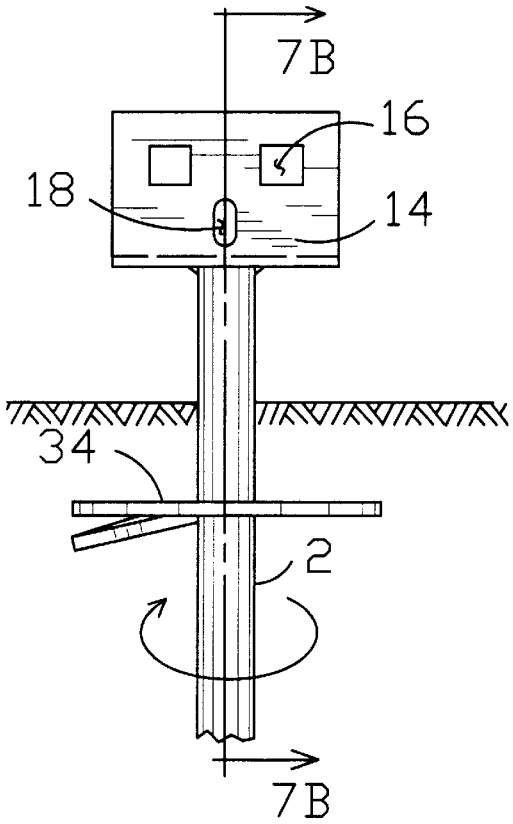
FIG. 7A is a cutaway sectional view of the drive head showing the elongated bearing.
Figure 7B:
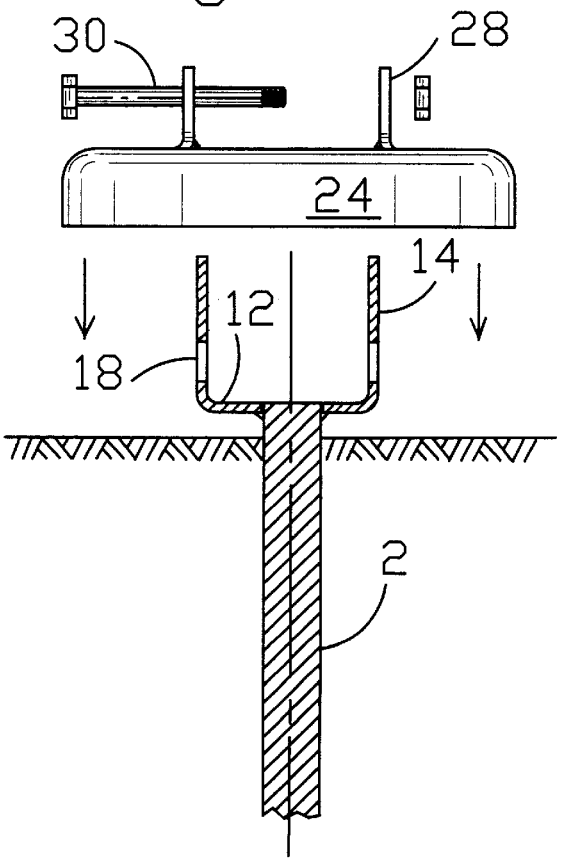
FIG. 7B is an exploded, cutaway sectional view of the drive section showing the stabilizing cap elevated above the drive head.

In both operations, when the anchor is set the stabilizing cap acts to compress and compact the soil about rod 2 as the anchor becomes set in the ground soil. It is noted that this packing action of stabilizing cap 10 occurs with or without the provision of a packing disk 34 as shown in FIG. 7B. It is, however, preferred that the packing disk be omitted.

It is known that federal regulations require that anchors for mobile homes must withstand pressures of between three and four thousand pounds without sustaining a bend in the rod of 1" or without allowing movement of the drive section of more than 3". The anchor of the invention has been tested and found to exceed these requirements.

Figure 6:
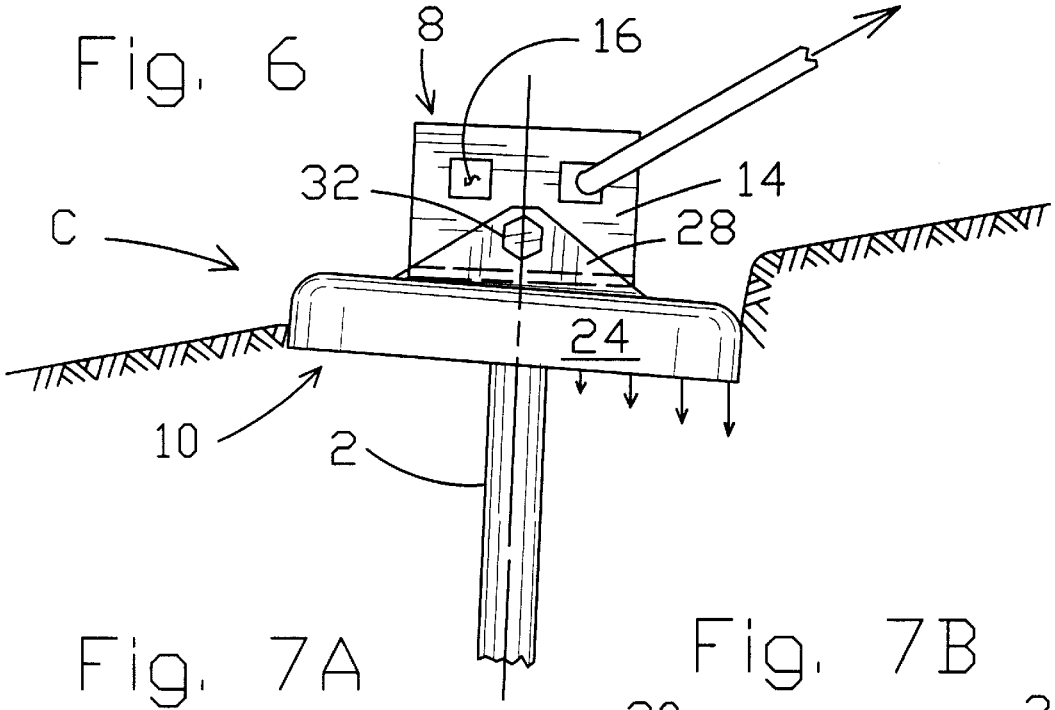
FIG. 6 is a sideview of the drive section of the anchor with the stabilizing cap reacting against pressure indicated by the arrow.

The primary reason for this improvement is thought to be brought about by stabilizing cap 10 having the capability of being evenly and fully seated with the ground surface as earlier described and shown in FIGS. 2 and 3. Also, it has been found that as pressure is applied in the direction of the arrow in FIG. 6, stabilizing cap 10 pivots downward on the side of rod 2 from the pressure is applied. This downward movement acts to further compact the soil about the upper end rod in the direction of pressure further stabilizing the rod in position.

Another advantage of the above described anchor is its ability to be packed in a compact area for shipping. This feature is, of course, brought about by the ability to separate the stabilizing cap from the rod. It has been found that this feature reduces shipping cost by about one-half.

While a preferred embodiment of the invention has been described using specific terms, such description is for illustrative purposes only, and it is to be understood that changes and variations may be made without departing from the spirit or scope of the following claims.

What is claimed is:

1. A post anchor for use with mobile homes comprising:

an elongated rod having an axis and including a boring section and a drive section;

said drive section including a drive head and a stabilizing cap;

said drive head including a pair of fixed spaced upright flanges positioned laterally of said rod, each said upright flange having a bearing elongated in the direction of said rod axis and arranged along a second axis transverse of said rod axis;

a mounting pin arranged along said second axis pivotally connecting said stabilizing cap with said upright flanges in a manner which allows vertical movement of said mounting pin; whereby, said stabilizing cap may be maintained aligned and evenly engaged with a ground surface about its periphery when said anchor is set in ground in which said surface is sloped.

2. The anchor of claim 1 wherein said boring section includes at least a beveled disk.

3. The anchor of claim 2 wherein said rod includes a compacting disk between said drive section and said boring section.

4. The anchor of claim 1 wherein said stabilizing cap includes an opening and a pair of opposed upright shoulders.

5. The anchor of claim 4 wherein said opening is large enough to receive said drive head.

6. The anchor of claim 4 wherein said shoulders mount said mounting pin.

7. The anchor of claim 4 wherein said stabilizing cap is about 6" in diameter.

8. The anchor of claim 4 wherein said stabilizing cap comprises a substantially planar, circular main portion with a downwardly directed flange.

9. The anchor of claim 8 wherein said flange is located about the periphery of said main portion and extends downwardly about 1".

10. An anchor capable of being secured in ground soil comprising:

an elongated metal rod;

a drive section located at a first end of said rod and a boring section located below said drive section and substantially adjacent a second end of said rod;

said drive section includes a drive connector, a stabilizing cap having a central opening which receives said drive connector, and a mounting apparatus, said mounting apparatus mounting said stabilizing cap for swiveling motion relative to said drive section; whereby, said stabilizing cap is adjusted for surface alignment with said ground soil when said anchor is set.

11. The anchor of claim 10 wherein said mounting apparatus comprises a pivot pin carried by said stabilizing cap and received through an elongated bearing formed in said drive connector, said elongated bearing allowing longitudinal and vertical pivoting motion of said stabilizing cap.

12. The anchor of claim 10 wherein said metal rod is about ¾" in diameter and about 36" long.

13. The anchor of claim 10 wherein said stabilizing cap is about 6" in diameter and includes a downwardly directed flange of about 1" in length.

14. A post anchor with an increased resistance to bending when subjected to high pressure when secured in ground soil, said post anchor comprising:

an elongated rod having an axis and including a drive section located adjacent a first end and a boring section located below said drive section, said boring section includes an auger for boring into said ground soil;

said drive section includes a drive connector in fixed position relative to said axis, a stabilizing cap, and a coupling connecting said stabilizing cap for swiveling motion with said drive connector; whereby, said stabilizing cap may be set in said ground soil in surface alignment and at an adjusted angle relative to said axis when said anchor is set.

15. A post anchor for use with mobile homes comprising:

an elongated rod having a boring section and a drive section;

said drive section including a drive head and a stabilizing cap secured with a first end of said rod;

said drive head including a pair of fixed spaced upright flanges positioned laterally of said rod, each said upright flange having a substantially vertically aligned elongated bearing;

said stabilizing cap including a central opening and a pair of opposed upright shoulders;

a mounting pin passing through said elongated bearings pivotally connecting said stabilizing cap with said upright flanges in a manner which allows horizontal and vertical pivotal movement of said stabilizing cap; whereby, said anchor may be set in ground having a sloped surface with said stabilizing cap substantially aligned and evenly engaged with said surface about its periphery.

16. The anchor of claim 15 wherein said elongated bearings are elongated in a substantially vertical direction.

17. An anchor capable of being in ground soil comprising:

an elongated metal rod;

a drive section located at a first end of said rod and a boring section located below said drive section and substantially adjacent a second end of said rod;

said drive section includes a drive connector, a stabilizing cap, and a mounting apparatus, said mounting apparatus pivotally mounting said stabilizing cap with said drive connector for swiveling motion relative to said elongated rod; whereby, said stabilizing cap is adjusted for surface alignment with said ground soil when said anchor is set.

18. The anchor of claim 17 wherein said stabilizing cap includes a central opening which receives said drive connector.

19. The anchor of claim 17 wherein said mounting apparatus comprises a pivot pin carried by said stabilizing cap and received through an elongated bearing formed in said drive connector, said elongated bearing allowing longitudinal and vertical pivoting motion of said stabilizing cap.

20. A post anchor with an increased resistance to bending when subjected to high pressure when secured in ground soil, said post anchor comprising:

an elongated rod having a drive section located adjacent a first end and a boring section located below said drive section, said boring section includes an auger for boring into said ground soil;

said drive section includes a drive connector, a stabilizing cap, and a coupling connecting said stabilizing cap for swiveling motion with said drive connector allowing said stabilizing cap when set in said ground soil to be in surface alignment with said ground soil when said anchor is set; whereby, said coupling allows said stabilizing cap to swivel when pressure is exerted against said rod, further compacting said ground soil and increasing said resistance of said rod to bending.

* * * * *